United States Patent [19]

Arcella

[11] 4,106,554

[45] Aug. 15, 1978

[54] HEAT PIPE HEAT AMPLIFIER

[75] Inventor: Frank G. Arcella, Bethel Park, Pa.

[73] Assignee: Westinghouse Electric Corp., Pittsburgh, Pa.

[21] Appl. No.: 818,779

[22] Filed: Jul. 25, 1977

[51] Int. Cl.[2] ..... F28D 15/00

[52] U.S. Cl. ..... 165/32; 165/105

[58] Field of Search ..... 73/27 R, 204; 165/32, 165/39, 105

[56] References Cited

U.S. PATENT DOCUMENTS

| | | | |
|---|---|---|---|
| 3,433,929 | 3/1969 | Snelling | 165/105 X |
| 3,564,727 | 2/1971 | Fraser | 165/105 X |
| 3,605,074 | 9/1971 | Freggens et al. | 165/105 X |
| 3,702,533 | 11/1972 | Dirne et al. | 165/105 |
| 4,033,406 | 7/1977 | Basiulis | 165/105 |

*Primary Examiner*—Herbert Goldstein

*Attorney, Agent, or Firm*—M. P. Lynch

[57] ABSTRACT

In a heat pipe combination consisting of a common condenser section with evaporator sections at either end, two working fluids of different vapor pressures are employed to effectively form two heat pipe sections within the same cavity to support an amplifier mode of operation.

8 Claims, 3 Drawing Figures

HEAT PIPE HEAT AMPLIFIER

BACKGROUND OF THE INVENTION

The combination of two conventional heat pipe structures in an end-to-end opposing relationship, with one end of the combination being exposed and responsive to the temperature of monitored environment or object, while the heat input to the opposite end is controlled, is disclosed in detail in pending U.S. Patent application Ser. No. 713,175, now U.S. Pat. No. 4,067,236, entitled "Novel Heat Pipe Combination", filed Aug. 10, 1976, assigned to the assignee of the present invention and incorporated herein by reference. In the structure disclosed in this referenced application, adjacent condenser sections of the respective heat pipe sections combine to form a common condenser region which is in turn coupled to an appropriate heat sink. The temperature of the monitored end and the temperature of the controlled end of the heat pipe combination each produce a vaporization of the working fluid in the wick portion of the respective heat pipe sections, which results in a flow of the respective vaporized fluids in opposing directions which ultimately meet to form an interaction interface within the common condenser region. The position of the interaction interface is a function of the vapor pressures in the respective heat pipe sections, which in turn is a function of the temperatures and the heat source strengths at the monitored and controlled ends of the heat pipe combination. The same working fluid is employed in the respective heat pipe sections of the heat pipe combination.

The heat, or temperature, at the monitored end can be controlled or measured by controllably introducing heat to the evaporator section corresponding to the controlled end of the heat pipe combination.

SUMMARY OF THE INVENTION

The efficiency of the heat pipe combination to control and monitor the heat, or temperature, of a monitored environment or object in accordance with the heat pipe combination structure defined in the above-referenced pending application can be significantly improved by utilizing two compatible working fluids of different vapor pressures in the heat pipe combination to establish an amplifier mode of operation of the heat pipe combination. The movement of the respective working fluids within the heat pipe combination is controlled by the heat input, or heat flux, from the heat sources associated with the evaporator sections disposed at either end of the common condenser section. One evaporator section is associated with the monitored environment or object and thus the monitored environment or object corresponds to its heat source while the opposite evaporator section is exposed to a controlled heat source.

During operation of the heat pipe combination, the more volatile working fluid will collect at the end of the condenser section farthest from the highest temperature heat source. With this separation of working fluids, two heat pipes will then be formed within the same working cavity. Since the vapors of the different working fluids will coexist at a common heat pipe pressure, and since the vapor pressures of both fluids can only be equal at different fluid temperatures, each end of the heat pipe combination will operate at a different temperature. The more volatile fluid, which has collected at the end of the condenser section farthest from the heat source to be controlled, can be heated via the controllable heat source. Less heat flux is required from the controllable heat source associated with the more volatile working fluid to effect changes in the heat flux, temperature, of the evaporator section associated with the monitored environment because the more volatile fluid has a greater vapor pressure than the other working fluid at a common temperature, and heat losses are less at the reduced temperatures of that portion of the condenser section occupied by the more volatile working fluid.

Thus, small power levels can be employed and amplified by the two fluid heat pipe combinations to achieve the same heat flow control of a single fluid heat pipe system requiring higher power levels.

The employment of two compatible working fluids with different vapor pressures in the same heat pipe cavity of the heat pipe combination disclosed in the above-identified pending application results in a heat pipe amplifier.

DESCRIPTION OF THE DRAWINGS

The invention will become more readily apparent from the following exemplary description in connection with the accompanying drawings.

DESCRIPTION OF THE PREFERRED EMBODIMENT

Figure 1:
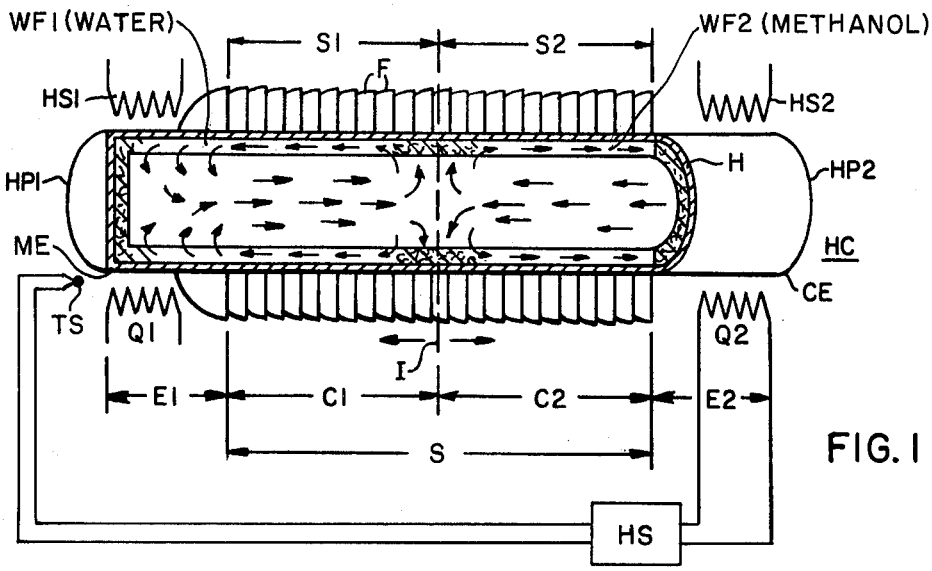
FIG. 1 is a sectioned schematic illustration of a heat pipe combination incorporating the invention.

Referring to FIG. 1 there is a sectioned illustration of a heat pipe combination HC in accordance with the teachings of the above-identified pending application wherein heat pipe section HP1 and a heat pipe section HP2 are combined to form the integral heat pipe combination HC having a common vapor cavity and a communicating wick structure. The construction of the respective heat pipe sections HP1 and HP2 is in accordance with conventional heat pipe technology wherein the portion of the heat pipe HP1 adjacent to the heat source HS1 is defined as the evaporator section E1, whereas the section of the heat pipe HP1 downstream from the evaporator section E1 and adjacent to the heat sink section S1 is defined as the condenser section C1. Similarly, the heat pipe HP2, which is connected in an end-to-end opposing relationship with the heat pipe HP1 to form the heat pipe combination HC consists of an evaporator section E2 adjacent to heat source HS2 and a condenser C2 corresponding to the portion of the heat pipe HP2 coupled to the heat sink section S2. Heat sink sections S1 and S2 are illustrated as consisting of radiator fins F which combine to form heat sink S of the heat pipe combination HC. Heat sink sections S1 and S2 can be radiative, convective or conductive. The heat pipes HP1 and HP2 are constructed in accordance with conventional heat pipe principles such as that disclosed in U.S. Pat. No. 3,681,843, entitled, HEAT PIPE WICK FABRICATION, issued Aug. 8, 1972, assigned to the assignee of the present invention, and incorporated herein by reference.

The integral combination of the heat pipes HP1 and HP2 defines an evacuated chamber, or cavity, 12 whose side walls are lined with a capillary, or wick 30, that is saturated with a volatile working fluid. The working fluid selected is dictated in part by the anticipated operating temperature, i.e., ammonia (−50° C to +50° C), methanol (0° C to 80° C), water (40° C to 150° C) and sodium (500° C to 800° C). The material selected for constructing the housing H is selected to be compatible with the working fluid, or fluids, and includes aluminum (ammonia), stainless steel (methanol and sodium) and copper (water and methanol).

The operation of the heat pipes HP1 and HP2 combines two familiar principles of physics; vapor heat transfer and capillary action. Vapor heat transfer serves to transport the heat energy from the evaporator section E1 and E2 to the condenser sections C1 and C2 respectively which collectively form the common condenser section. The vapor flow from the respective heat pipes contact to form a common interaction interface I. The location of the interaction interface I within the common condenser section CS is a function of the relative strengths of the heat sources HS1 and HS2. Capillary action returns the condensed working fluids of the respective heat pipes HP1 and HP2 back to the respective evaporator sections, as indicated by the arrows in FIG. 1, to complete the cycle.

The working fluids in the respective heat pipes absorb heat at the evaporator sections E1 and E2 and change its liquid state to a gaseous state. The amount of heat necessary to cause this change of state is the latent heat of vaporization. As the working fluid in the respective heat pipes vaporizes, the pressure in the evaporator sections E1 and E2 increases. The vapor pressure sets up a pressure differential between the evaporator sections and the condenser sections of the respective heat pipes HP1 and HP2, and this differential pressure causes the vapor, and thus the heat energy, to move from the evaporator sections to the condenser sections of the respective heat pipes. When the vapor arrives at the condenser sections C1 and C2, they are subjected to a temperature slightly lower than that of the evaporator sections due to thermal coupling to the heat sinks S1 and S2, and condensing occurs thereby releasing the thermal energy stored in the heat of vaporization at the respective condenser sections. As the vapor condenses the pressure at the condenser sections C1 and C2 decreases so that the necessary pressure differential for continued vapor heat flow is maintained.

Movement of the working fluids from the respective condenser sections to the evaporator sections is accomplished by capillary action within the wick 30 which connects the condenser and evaporator sections of the respective heat pipes. The interaction interface I corresponds to the interface established by the mixing or contact of the opposed vapor flow patterns of the working fluids effected by the respective heat pipes HP1 and HP2. The location of the interaction interface I within the common condenser section of the heat pipe combination HC is a function of the heat strengths Q1 and Q2 associated with the heat sources HS1 and HS2 respectively.

Assume, for the purposes of discussion, that the heat source HS1 corresponds to a monitored environment or or object such as an electronic circuit package or a fluid flow medium which exhibits an unknown temperature condition that serves as a heat input, or heat flux, to the evaporator section E1. The evaporator section E1 of heat pipe HP1 corresponds to the monitored end of the heat pipe combination HC whereas the evaporator section E2 of heat pipe HP2 corresponds to the controlled end of the heat pipe combination HC inasmuch as its heat source HS2 is determined by the controlled heat input from a controllable heat source HS.

In the typical embodiment of FIG. 1, which is described in detail in the above-referenced pending application, a temperature signal from a temperature sensor TS associated with the monitored end ME of the heat pipe combination HC serves as an input to the controllable heat source HS which in turn controls the heat strength Q2 of the controlled end CE to effect movement of the interaction interface I to control the amount of condenser section and corresponding heat sink section available to the monitored end ME to control the heat flow from the monitored end ME and thereby control the temperature of the monitored end ME.

The effectiveness and efficiency of the heat pipe combination can be substantially improved by employing different working fluids in the respective heat pipes, each working fluid, WF1 and WF2, exhibiting different vapor pressures. The use of compatible working fluids, i.e., water and methanol, exhibiting different vapor pressures in the heat pipe combination HC supports an amplifier mode of operation such that the heat pipe combination HC functions as a heat pipe heat amplifier. Inasmuch as the evaporator sections E1 and E2 operate with a common over-pressure, i.e., there is vapor communication between evaporator sections E1 and E2, the temperatures of both evaporator sections relate through the vapor pressure curves of the respective working fluids WF1 and WF2 associated with the heat pipe sections HP1 and HP2 respectively. As a result, a small change in heat flux HS2 at evaporator section E2 will take up condenser area at section C2 causing the temperature at evaporator section E1 to change due to a loss in its condenser area at C1. Since the temperature at E2 is lower than the temperature at E1, a small change in temperature at evaporator section E2 is amplified in effect at E1, thus heat transfer effects at one end of the heat pipe combination HC are amplified at the other end.

During operation of the heat pipe combination HC, the more volatile working fluid will collect at the end of the condenser section CS farthest from the highest temperature heat source. Since the vapors of the working fluids will coexist at a common heat pipe pressure, and since the vapor pressures of both working fluids can only be equal at different fluid temperatures, each end, i.e., the controlled end CE and the monitored end ME, of the heat pipe combination HC will operate at a different temperature. The more volatile working fluid WF2, which in the case of the water-methanol working fluid combination is the methanol, has collected at the end of the condenser section farthest from the heat source HS1 of the monitored end ME, can be heated as a result of heat input from the controllable heat source HS2 associated with the controlled end CE. Less heat flux is required at the controlled end CE which is associated with the more volatile working fluid WF2 to effect changes in the heat flux, or heat flow from, or temperature of, the evaporator section E1 of the monitored end ME because the more volatile working fluid WF2 has:

1. a greater vapor pressure than the working fluid WF1 at a common temperature, and 2. heat losses are less at the reduced temperatures of the condenser section C2 associated with the more volatile working fluid WF2.

Thus, the employment of two compatible working fluids, each exhibiting different vapor pressures, in the same heat pipe cavity of the heat pipe combination HC results in a heat pipe heat amplifier mode of operation.

Figure 2:
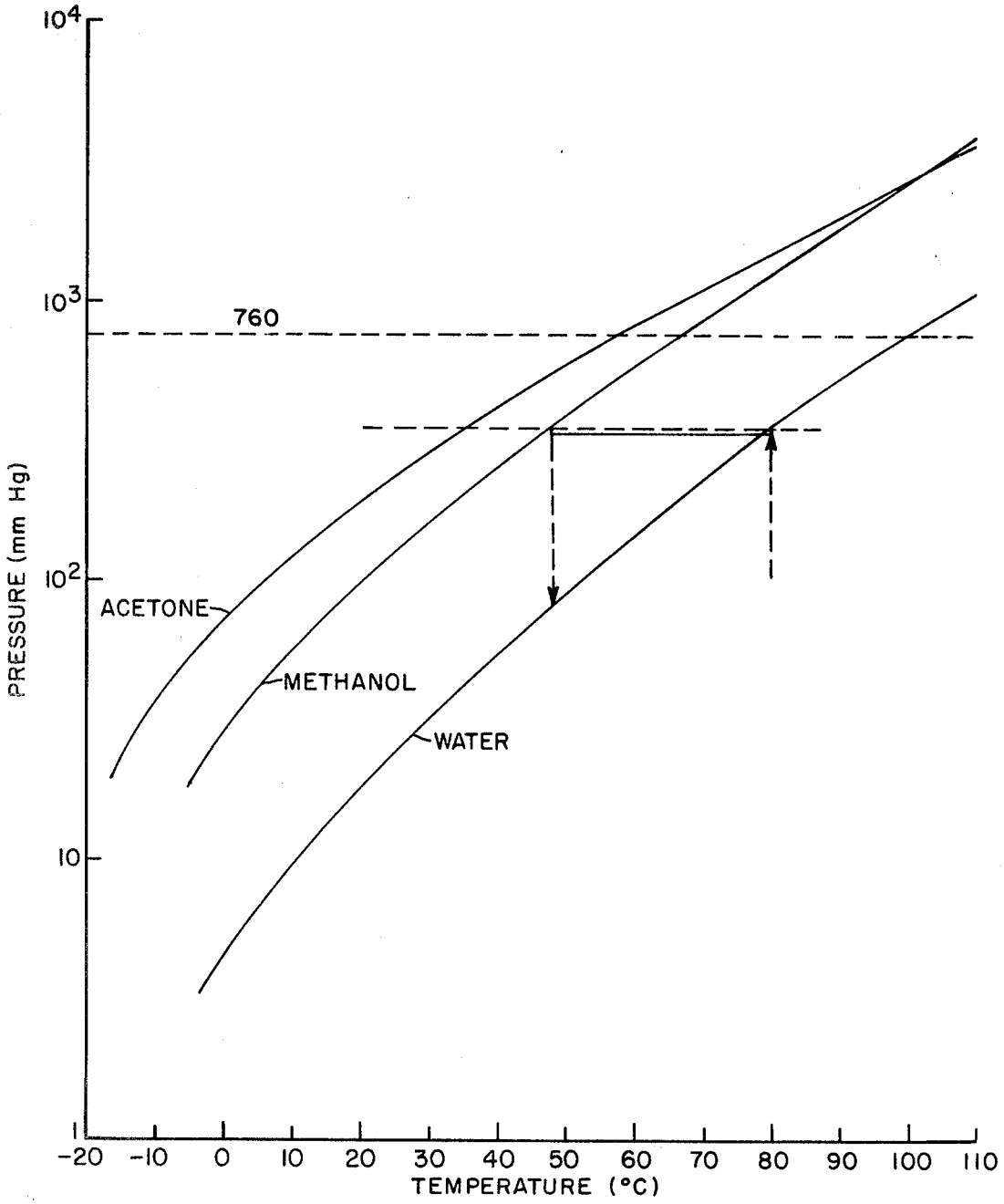
FIG. 2 is a graphical illustration of the vapor pressure curves of various heat pipe working fluids.

A graphical illustration of the vapor pressures of a few low temperature heat pipe working fluids is illustrated in FIG. 2. Referring to FIG. 2, it is seen, for a 50:50 water-methanol working fluid combination in the heat pipe combination HC, when the evaporator section associated with the water working fluid is at 80° C, the evaporator section associated with the methanol working fluid will be at 48° C due to intercommunication of vapor pressures.

Figure 3:
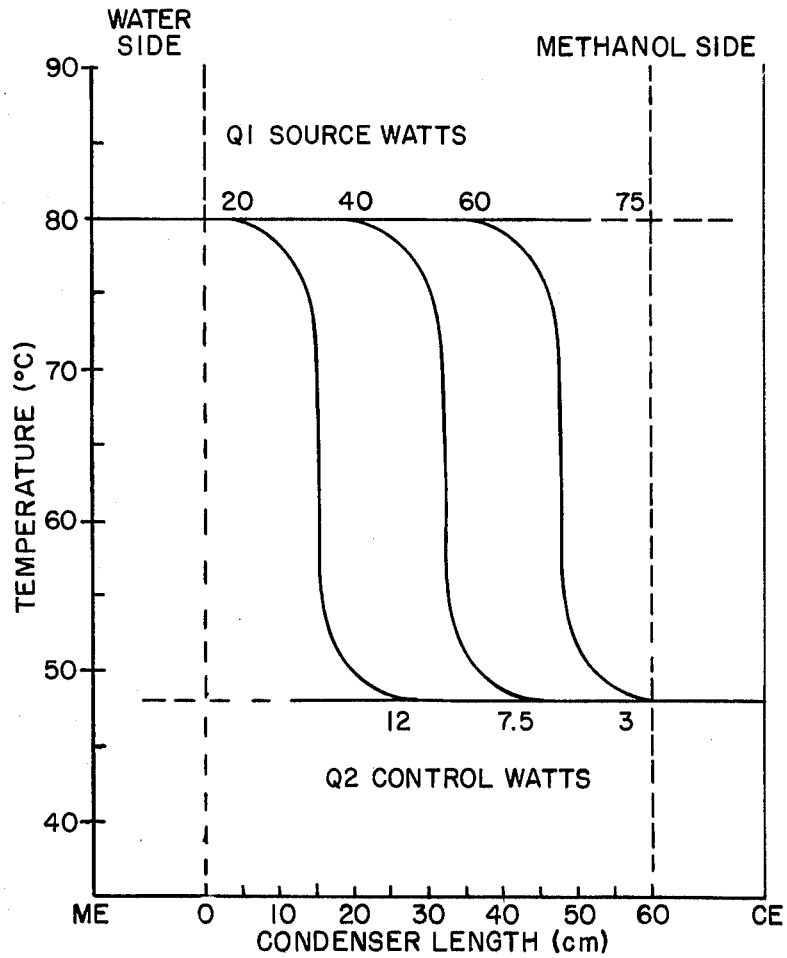
FIG. 3 is a graphical illustration of thermal profiles for a 50:50 water-methanol working fluid combination in a heat pipe heat amplifier such as that illustrated in FIG. 1.

For the purpose of dicussion, consider a heat pipe combination with an overall length of approximately 60 centimeters and employing a convection air-cooled condenser. Assuming equalized internal pressures, with one evaporator section containing methanol at 48° C, the steady-state heat transfer thermal profiles can be projected as illustrated in FIG. 3. Since the end of the heat pipe combination employing methanol as a working fluid operates at a much lower temperature, heat dissipation through the condenser section associated with the methanol is lower per unit axial length than that of the condenser section associated with the end of the heat pipe combination employing a water working fluid. The amplification of control is apparent from FIG. 3. The amplification mode has been verified experimentally in a heat pipe combination HC employing: (1) identical working fluids in the respective heat pipes; and (2) a heat pipe combination employing working fluids of different vapor pressures. In the heat pipe combination employing identical working fluids, control of 60 watts at the monitored end ME at 80° C required 15 watts of heat input at the controlled end CE. However, as illustrated in FIG. 3, in a two-fluid heat pipe combination, i.e., water-methanol, the control of 60 watts at the monitored end ME at 80° C requires a heat input at the controlled end CE of only 3.1 watts, which when compared to 15 watts, establishes an amplification factor 4.6 for the heat pipe combination employing the two working fluids.

While the above discussion was directed to a water-methanol combination of working fluids, similar desirable amplification results from the use of other working fluid combinations such as sodium-potassium and water-acetone. Methanol, potassium and acetone represent the higher vapor pressure working fluids.

I claim:

1. A heat pipe amplifier apparatus, comprising, a heat pipe combination means including a first and second heat pipe means each having an evaporator section and a condenser section, said first and second heat pipe means being coupled such that said condenser sections combine to form a common condenser section, heat sink means operatively coupled to said common condenser section, and a first working fluid operatively associated with said first heat pipe means and a second working fluid associated with said second heat pipe means, said first and second working fluids being in contact in said common condenser section, the vapor pressures of the respective working fluids being different at a common temperature.

2. A heat pipe amplifier apparatus as claimed in claim 1 wherein said working fluid associated with said first heat pipe means is water and the working fluid associated with said second heat pipe means is methanol.

3. A heat pipe amplifier apparatus as claimed in claim 1 wherein the working fluid operatively associated with the first heat pipe means has a lower vapor pressure than the working fluid associated with said second heat pipe means such that said heat pipe combination forms a heat pipe amplifier with heat changes at the evaporator section of said first heat pipe means being thermally controlled by smaller heat flux changes at the evaporator section of said second heat pipe means.

4. A heat pipe amplifier apparatus as claimed in claim 3 wherein the evaporator section of said first heat pipe means is exposed to a monitored environment, and a controllable heating means is operatively coupled to the evaporator section of said second heat pipe means to control the temperature of said monitored environment by controlling the heat input to the evaporator section of said second heat pipe means.

5. A heat pipe amplifier apparatus as claimed in claim 1 wherein said evaporator section of said first heat pipe means is associated with a monitored environment and a controllable heat source is operatively associated with the evaporator section of said second heat pipe means.

6. A heat pipe amplifier apparatus as claimed in claim 5 including a temperature sensor for measuring the temperature of the monitored environment and developing a signal indicative thereof, said signal being supplied to control said controllable heat source.

7. A heat pipe amplifier apparatus as claimed in claim 1 wherein said working fluid associated with said first heat pipe means is sodium and the working fluid associated with said second heat pipe means is potassium.

8. A heat pipe amplifier apparatus as claimed in claim 1 wherein said working fluid associated with said first heat pipe means is water and the working fluid associated with said second heat pipe means is acetone.

* * * * *